US012302953B2

(12) United States Patent
Williams

(10) Patent No.: US 12,302,953 B2
(45) Date of Patent: May 20, 2025

(54) COLLAR FOR A GARMENT

(71) Applicant: PUMA SE, Herzogenaurach (DE)

(72) Inventor: Howard Williams, Hong Kong (CN)

(73) Assignee: PUMA SE, Herzogenaurach (DE)

( * ) Notice: Subject to any disclaimer, the term of this patent is extended or adjusted under 35 U.S.C. 154(b) by 251 days.

(21) Appl. No.: 17/366,943

(22) Filed: Jul. 2, 2021

(65) Prior Publication Data

US 2023/0000175 A1 Jan. 5, 2023

(51) Int. Cl.
*A41B 3/00* (2006.01)
*A41B 5/00* (2006.01)

(52) U.S. Cl.
CPC . *A41B 3/00* (2013.01); *A41B 5/00* (2013.01)

(58) Field of Classification Search
None
See application file for complete search history.

(56) References Cited

U.S. PATENT DOCUMENTS 161,110 A * 3/1875 Fisk ..... A41B 3/00 2/116
2,021,833 A * 11/1935 Campbell ..... A41B 3/00 2/143
2,099,520 A * 11/1937 Hendryey ..... A41B 3/00 2/131
2,344,204 A * 3/1944 Doumaux ..... A41B 3/00 2/116
3,131,555 A * 5/1964 Rappaport ..... A41D 27/18 2/116
3,293,662 A 12/1966 Seiler
4,038,840 A 8/1977 Castello
4,538,302 A * 9/1985 Thurman ..... A41D 25/14 2/153
8,161,574 B2 * 4/2012 Litt ..... D06J 1/12 2/116
2002/0120974 A1 * 9/2002 Krause ..... A41B 3/00 2/127
2004/0142629 A1 * 7/2004 Rabinowicz ..... A41C 3/0007 450/1
2009/0282604 A1 * 11/2009 Litt ..... D06J 1/12 2/139
2020/0397060 A1 * 12/2020 O'Neal ..... A41B 3/06
2021/0127758 A1 * 5/2021 Morisch Hurst ..... A41B 17/00

FOREIGN PATENT DOCUMENTS

CN 108175129 A * 6/2018
CN 108175143 6/2018
JP S6360424 U 4/1988
JP 2001295116 A 10/2001
JP 2002069729 A 3/2002
WO 2017174101 A1 10/2017

OTHER PUBLICATIONS

Translation of CN 108175129 A, obtained on Jun. 30, 2023 via Espacenet Patent Translate (Year: 2023).*
International Search Report in Application No. PCT/IB2022/056068, dated Sep. 5, 2022 (3 pages).
Written Opinion in Application No. PCT/IB2022/056068, dated Sep. 5, 2022 (6 pages).

* cited by examiner

*Primary Examiner* — Jocelyn Bravo
(74) *Attorney, Agent, or Firm* — Quarles & Brady LLP

(57) ABSTRACT

A collar includes a leaf having a first edge and a second edge, a stand having a concavely curved inner edge, and a fold line adjoining the leaf to the stand. The fold line may be convexly curved between the first edge and the second edge, and the stand is formed as a mesh portion.

21 Claims, 3 Drawing Sheets

COLLAR FOR A GARMENT

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to a collar for a garment.

2. Description of the Background

Garments and/or articles of clothing often include a collar that is customarily folded down when being worn by a user.

SUMMARY

A collar for a garment, as described herein, may have various configurations.

In some embodiments, a collar may include a leaf having a first edge and a second edge, a stand having a concavely curved inner edge, and a fold line adjoining the leaf to the stand. The fold line may be convexly curved between the first edge, the second edge, and the inner edge, and the stand is formed as a mesh portion.

In some aspects, the collar is composed of polyester yarn and elastane yarn. Additionally or alternatively, the collar is composed of cotton yarn and elastane yarn. An outer edge of the leaf extends linearly between the first edge and the second edge. The fold line can include an inner side and an outer side, the inner side having a protruding portion and the outer side having a gap. The fold line can curve continuously between the first edge and the second edge of the collar. The fold line may intersect the first edge and the inner edge at a first intersection. A distance between an outer edge of the leaf and the inner edge of the stand can be greatest at a central plane that is positioned equidistant from the first edge and the second edge of the leaf.

In some embodiments, a collar includes a leaf including a first edge and a second edge, a stand including a concavely curved inner edge, and a fold line adjoining the leaf to the stand. The fold line can be convexly curved between the first edge and the second edge, and the stand can further include a mesh portion extending along the inner edge. The mesh portion may be spaced apart from the fold line.

In some aspects, the mesh portion extends between a first inflexion point and a second inflexion point of the inner edge of the stand. The mesh portion can be generally shaped as a semi-circle, or as a trapezoid. The collar may be composed of polyester yarn and elastane yarn or of cotton yarn and elastane yarn.

In some aspects, an outer edge of the leaf extends linearly between the first edge and the second edge. The fold line may have a reduced density relative to a density of the leaf. In another aspect a portion of the fold line curves along a radius of curvature about a first inflexion point of the inner edge of the stand. The fold line can curve continuously between the first edge and the second edge of the collar. A height of the leaf varies between the first edge and the second edge.

In some embodiments, a collar for a garment includes a leaf having an outer edge that extends linearly between a first edge and a second edge, a stand including an inner edge, and a fold line adjoining the leaf to the stand. The fold line can be convexly curved between the first edge and the second edge. The fold line can intersect the first edge and the inner edge at a first intersection, the first edge may extend at an angle between the first intersection and the outer edge and the stand may further include a mesh portion.

BRIEF DESCRIPTION OF THE DRAWINGS

The drawings described herein are for illustrative purposes only of selected configurations and are not intended to limit the scope of the present disclosure.

Figure 1:
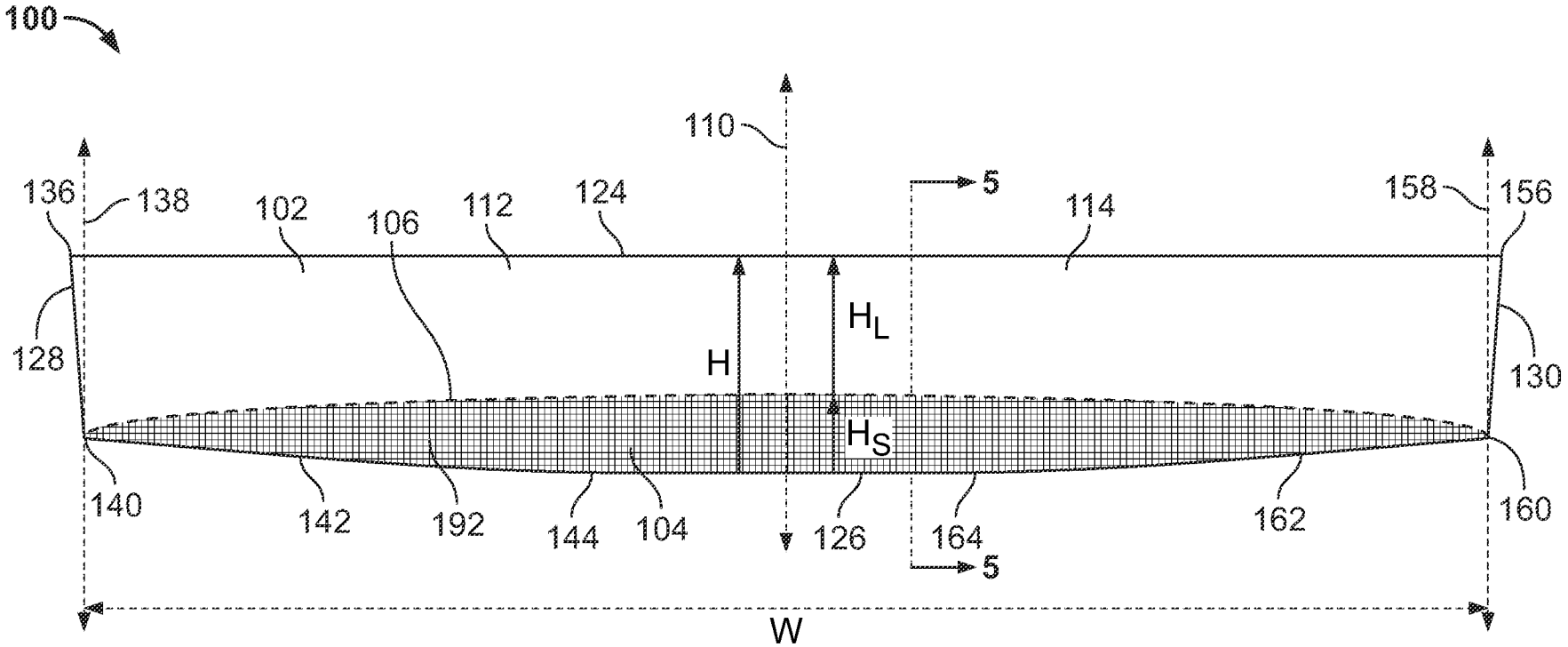
FIG. 1 is a planar view of a collar.

Other aspects and advantages of the present invention will become apparent upon consideration of the following detailed description, wherein similar structures have similar references numerals.

DETAILED DESCRIPTION OF THE DRAWINGS

Several aspects of the present invention are described herein with specificity to meet statutory requirements, but this description is not necessarily intended to limit the scope of the claims. The claimed subject matter may be embodied in other ways, may include different elements or steps, and may be used in conjunction with other existing or future technologies.

The term "about," as used herein, refers to variation in the numerical quantity that may occur, for example, through typical measuring and manufacturing procedures used for articles of clothing or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

As used herein in the context of geometric descriptions, unless otherwise limited or defined, "substantially" indicates correspondence to a particular shape or dimension within conventional manufacturing tolerances for components of a similar type or that are formed using similar processes. In this regard, for example, "substantially round" can indicate a profile that deviates from a circle to within acceptable manufacturing tolerances.

Further, as used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations.

The terms first, second, third, etc. may be used herein to describe various elements, components, regions, layers and or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The present disclosure is directed to a collar for a garment. The collar may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The collar may comprise a variety of materials, such as a first yarn, a second yarn, and/or a third yarn, which may have varying properties or varying visual characteristics.

Referring to FIG. 1, an example of a collar 100 includes an outer portion or leaf 102, an inner portion or stand 104, and a fold line 106 that adjoins the leaf 102 to the stand 104. The collar 100 is intersected by a central plane or axis 110 that divides the collar 100 into a first region 112 and a second region 114. The central plane 110 may be positioned on the collar 100 so as to bisect the collar 100 into first and second regions 112, 114 that are of equal size and mirrored about the central plane 110. In some examples, the central plane 110 may be positioned so that the first region 112 and the second region 114 are not mirrored about the central plane 110, or so that the first region 112 has different dimensions, appearance, performance properties, or other attributes that differ from the second region 114.

Unless otherwise specified, the first region 112 and the second region 114 are intended to define boundaries or areas of the collar 100. To that end, the first region 112 and the second region 114 generally characterize sections of the collar 100. Further, the leaf 102, the stand 104, and the fold line 106 may be characterized as having portions within the first region 112 and the second region 114. Therefore, the leaf 102, the stand 104, and the fold line 106, and/or individual portions of the leaf 102, the stand 104, and the fold line 106, may include portions thereof that are disposed within the first region 112 and the second region 114.

It should be understood that numerous modifications may be apparent to those skilled in the art in view of the description herein, and individual components thereof, may be incorporated into numerous collars or garments. Accordingly, aspects of the collar 100 and components thereof, may be described with reference to general areas or portions of the collar 100, with an understanding the boundaries of the first region 112 and the second region 114 as described herein may vary between collars. Furthermore, the aspects of the collar 100 and individual components thereof, may also be described with reference to exact areas or portion of the collar 100 and the scope of the appended claims herein may incorporate the limitations associated with these boundaries of the first region 112 and the second region 114.

The collar 100 includes an outer edge 124 and an inner edge or neck seam 126 that both extend between a first edge 128 and a second edge 130, the outer edge 124 being disposed opposite the inner edge 126. The first edge 128 extends between the outer edge 124 and the inner edge 126, and the first edge 128 is disposed within the first region 112. The second edge 130 extends between the outer edge 124 and the inner edge 126, and the second edge 130 is disposed within the second region 114, opposite the first edge 128. Accordingly, the outer edge 124 and the inner edge 126 both extend across the first region 112 and the second region 114 of the collar 100, and both the outer edge 124 and the inner edge 126 are spaced apart from each other and intersected by the central plane 110. In the example of FIG. 1, the outer edge 124 is linear (e.g., straight) and extends in a direction that is substantially perpendicular to the central plane 110. In other examples, the outer edge 124 may not be straight and may extend at least partially or entirely at an angle with respect to the central plane 110. For example, the outer edge 124 may include curved portions or notched portions therealong. In addition, the outer edge 124 may be shaped differently in the first region 112 than in the second region 114.

The first edge 128 and the outer edge 124 together define a first corner 136 within the first region 112, and the first edge 128 extends away from the outer edge 124 toward the inner edge 126 at an angle with respect to a first plane 138 that is parallel with and spaced apart from the central plane 110. The first plane 138 may include stitching partially or continuously therealong and the first plane 138 intersects the outer edge 124 at a point between the first corner 136 and the central plane 110. The first edge 128 and the inner edge 126 together define a first intersection 140 where the fold line 106 and the first plane 138 adjoin within the first region 112. That is, the first intersection 140 includes the intersection of the inner edge 126, the first edge 128, the fold line 106, and the first plane 138 within the first region 112 of the collar 100. Further, a first segment 142 of the inner edge 126 extends away from the first intersection 140 toward the central plane 110. In the example of FIG. 1, the first segment 142 extends at an angle with respect to the central plane 110 and to a first inflexion point 144 of the inner edge 126.

With continued reference to FIG. 1, the inner edge 126 extends substantially perpendicular to the central plane 110 between the first inflexion point 144 and the central plane 110, and then the first segment 142 of the inner edge 126 extends at an angle or curves with respect to the central plane 110 between the first intersection 140 and the first inflexion point 144. In this manner, the inner edge 126 of the collar 100 can be concavely curved relative to the outer edge 124. Accordingly, a total height H of the collar 100, i.e., a distance between the outer edge 124 and the inner edge 126, is smaller when measured between the outer edge 124 and the first intersection 140 than between the outer edge 124 and the first inflexion point 144. In other words, the total height H of the collar 100 within the first region 112 increases moving in a direction from the first edge 128 toward the central plane 110 until the first inflexion point 144 is reached. The total height H of the collar 100 within the first region 112 is constant between the first inflexion point 144 and the central plane 110.

The fold line 106 within the first region 112 extends between the first intersection 140 and the central plane 110, and the fold line 106 curves gradually from the first intersection 140 to the central plane 110. The curvature of the fold line 106 within the first region 112 may be defined by a radius of curvature about the first inflexion point 144. In some examples, the radius of curvature is constant, but in other examples the radius of curvature may vary along the fold line 106, e.g., the curvature may be steeper near the first intersection 140 and gradually flatten toward the central plane 110. In this manner, the fold line 106 may be convexly curved within the first region 112 relative to the first inflexion point 144 of the inner edge 126. In addition, a leaf height $H_L$ is defined between the outer edge 124 and the fold line 106, such that the leaf height $H_L$ changes as the location and curvature of the fold line 106 changes. Further, a stand height $H_S$ is defined between the inner edge 126 and the fold line 106, opposite the leaf height $H_L$. The stand height $H_S$ also changes as the location and curvature of the fold line 106 changes. The curvature of the fold line 106 may vary as a function of distance from the central plane 110 and, as a result, the leaf height $H_L$ and the stand height $H_S$ also vary as a function of distance from the central plane 110.

The second edge 130 and the outer edge 124 together define a second corner 156 within the second region 114, and the second edge 130 extends away from the outer edge 124 toward the inner edge 126 at an angle with respect to a second plane 158 that is parallel with and spaced apart from the central plane 110. The second plane 158 may include stitching partially or continuously therealong and the second plane 158 intersects the outer edge 124 at a point between the second corner 156 and the central plane 110. The second edge 130 and the inner edge 126 together define a second intersection 160 where the fold line 106 and the second plane 158 adjoin within the second region 114. That is, the second intersection 160 includes the intersection of the inner edge 126, the second edge 130, the fold line 106, and the second plane 158 within the second region 114 of the collar 100. Further, a second segment 162 of the inner edge 126 extends away from the second intersection 160 toward the central plane 110. In the example of FIG. 1, the second segment 162 extends at an angle with respect to the central plane 110 and to a second inflexion point 164 of the inner edge 126.

With continued reference to FIG. 1, the inner edge 126 extends substantially perpendicular to the central plane 110 between the second inflexion point 164 and the central plane 110, and then the second segment 162 of the inner edge 126 extends at an angle or curves with respect to the central plane 110 between the second intersection 160 and the second inflexion point 164. In this manner, the inner edge 126 of the collar 100 can be concavely curved relative to the outer edge 124. Accordingly, the total height H of the collar 100 is smaller when measured between the outer edge 124 and the second intersection 160 than between the outer edge 124 and the second inflexion point 164. In other words, the total height H of the collar 100 within the second region 114 increases moving in a direction from the second edge 130 toward the central plane 110 until the second inflexion point 164 is reached. The total height H of the collar 100 within the second region 114 is constant between the second inflexion point 164 and the central plane 110.

The fold line 106 within the second region 114 extends between the second intersection 160 and the central plane 110, and the fold line 106 curves gradually from the second intersection 160 to the central plane 110. The curvature of the fold line 106 within the second region 114 may be defined by a radius of curvature about the second inflexion point 164. In some examples, the radius of curvature is constant, but in other examples the radius of curvature may vary along the fold line 106, e.g., the curvature may be steeper near the second intersection 160 and gradually flatten toward the central plane 110. In this manner, the fold line 106 may be convexly curved within the second region 114 relative to the second inflexion point 164 of the inner edge 126. In addition, the leaf height $H_L$ changes as the location and curvature of the fold line 106 changes and the stand height $H_S$ also changes as the location and curvature of the fold line 106 changes. The curvature of the fold line 106 may vary as a function of distance from the central plane 110 and, as a result, the leaf height $H_L$ and the stand height $H_S$ also vary as a function of distance from the central plane 110. Further, the collar 100 has a width W, i.e., a distance between the first edge 128 and the second edge 130, that is greater between the first corner 136 and the second corner 156 than between the first intersection 140 and the second intersection 160. Accordingly, the first corner 136 is positioned farther from the central plane 110 than the first plane 138 and the first intersection 140. In addition, the second corner 156 is positioned farther from the central plane 110 than the second plane 158 and the second intersection 160. In other words, the collar 100 is widest (i.e., the width W is greatest) along the outer edge 124 between the first corner 136 and the second corner 156, while the collar is narrowest (i.e., the width W is smallest) along the inner edge 126 between the first intersection 140 and the second intersection 160. It is contemplated that the outer edge 124 and the inner edge 126 may define equal distances therealong but may still include first and second corners 136, 156 spaced apart a greater distance than first and second intersections 140, 160, or vice versa.

Figure 2:
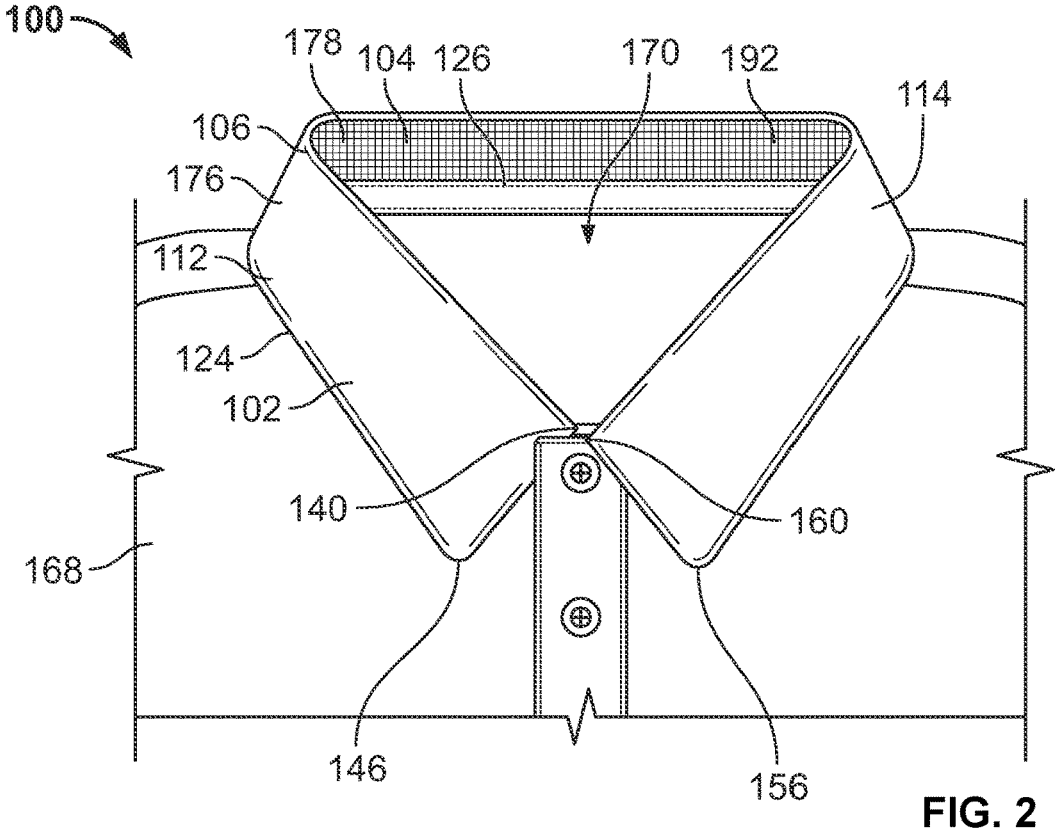
FIG. 2 is a front view of the collar of FIG. 1, being shown attached to an example garment and folded down over itself.
Figure 3:
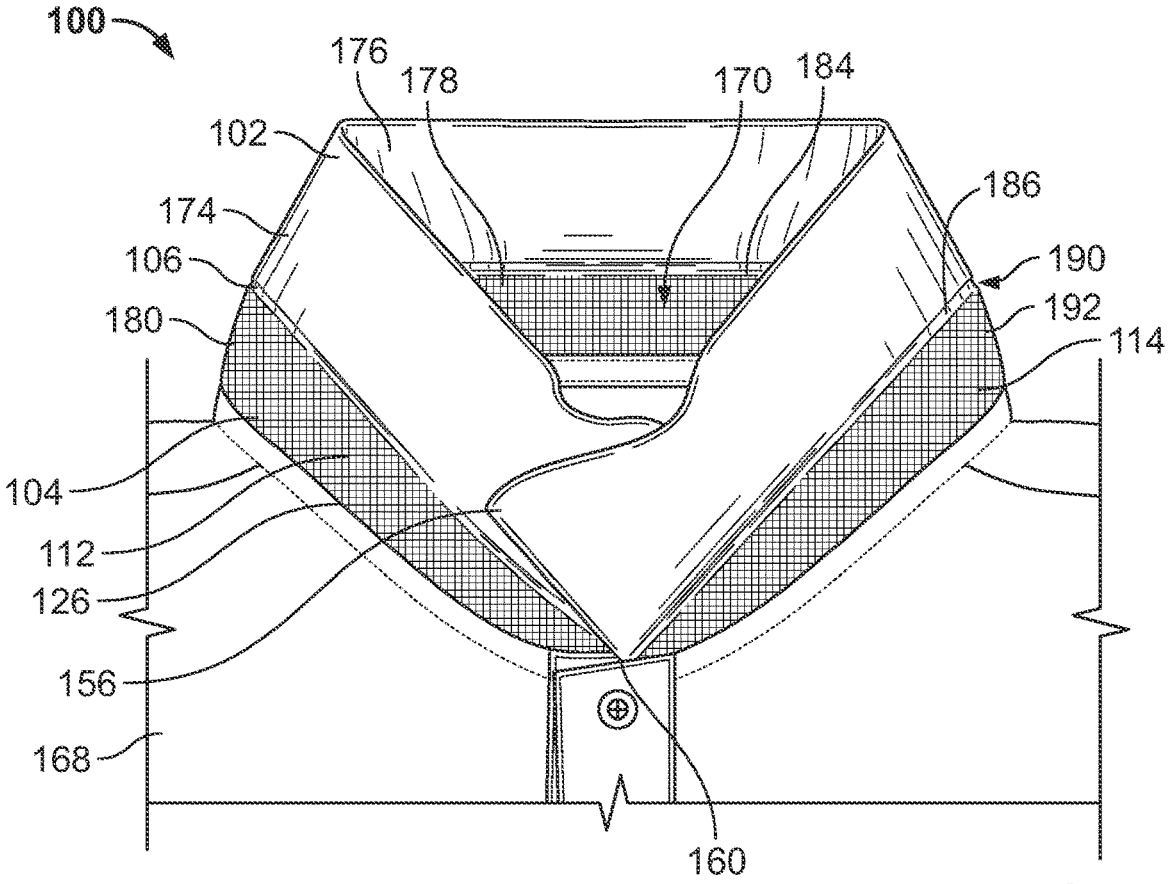
FIG. 3 is a front view of the collar of FIG. 1, being shown attached to a garment and unfolded.
Figure 5:
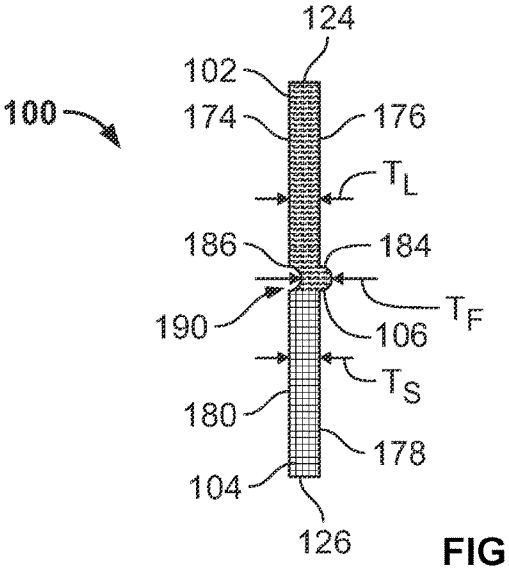
FIG. 5 is a sectional view of the collar of FIG. 1 taken along the line 5-5 in FIG. 1.

Referring to FIGS. 2 and 3, the collar 100 is attached to a garment 168 along the inner edge 126, such that the collar 100 is disposed about a neck opening 170. In FIG. 2, the leaf 102 of the collar 100 is folded over the stand 104 along the fold line 106. The leaf 102 includes an outer leaf surface 174 that is opposite an inner leaf surface 176, and the stand 104 includes an inner stand surface 178 and an outer stand surface 180 that is opposite the inner stand surface 178. As illustrated in FIG. 5, a leaf thickness $T_L$ is defined between the outer leaf surface 174 and the inner leaf surface 176, and a stand thickness $T_S$ is defined between the inner stand surface 178 and the outer stand surface 180. In some embodiments, the leaf thickness $T_L$ and the stand thickness $T_S$ may be identical and constant along the first region 112 and the second region 114. In other embodiments the leaf thickness $T_L$ may be greater than the stand thickness $T_S$, or vice versa, and each of the leaf thickness $T_L$ and the stand thickness $T_S$ may vary along the first region 112 and the second region 114.

In an unfolded configuration, as depicted in FIGS. 3 and 5, the outer leaf surface 174 and the outer stand surface 180 are positioned to face the same direction as each other and to be coplanar with each other. Similarly, in the unfolded configuration, the inner leaf surface 176 and the inner stand surface 178 are positioned to face the same direction as each other and to be coplanar with each other, opposite the direction that the outer leaf surface 174 and the outer stand surface 180 are positioned to face. When the collar 100 is in a folded configuration, as depicted in FIG. 2, the leaf 102 is rotated about the fold line 106 so the outer leaf surface 174 is placed proximate and adjacent to the stand 104. More specifically, the outer leaf surface 174 is positioned to face the outer stand surface 180 when the collar 100 is folded.

Referring to FIGS. 3 and 5, the fold line 106 includes an inner fold portion 184 and an outer fold portion 186 that is opposite the inner fold portion 184. The inner fold portion 184 is disposed between the inner leaf surface 176 and the inner stand surface 178, and the outer fold portion 186 is disposed between the outer leaf surface 174 and the outer stand surface 180. The inner fold portion 184 may protrude along the fold line 106 while the outer fold portion 186 may protrude into the fold line 106, such that the fold line forms a gap 190 between the outer leaf surface 174 and the outer stand surface 180. Further, the fold line 106 defines a fold thickness $T_F$ that is smaller than the leaf thickness $T_L$ and the stand thickness $T_S$. In some embodiments, the fold line 106 may have a thickness $T_S$ that is approximately 70% or less of the leaf thickness $T_L$ or the stand thickness $T_S$. In some embodiments, the fold thickness $T_F$ may be larger than the leaf thickness $T_L$ or the stand thickness $T_S$. In addition, the density, i.e., a weight of a fabric in a particular region which is measured in grams per square meter (GSM), of the fold line 106 may be less than the density of the leaf 102 or the stand 104. The density of the fold line 106 can be manipulated by using particular materials, methods of forming fabric, or the shape of the measured region itself. For example, the fold line 106 may have a greater thickness $T_F$ but still have a reduced density, such as by material selection or use of certain knitting or weaving methods, in comparison to the leaf 102 or the stand 104. In this manner, the collar 100 is configured to be self-folding, such that the gap 190 and a reduced fold thickness $T_F$ cooperate to bias the collar 100 into a folded configuration. Alternatively, the gap 190 and the reduced density of the fold line 106 in comparison to the leaf 102 or the stand 104 may cooperate to bias the collar 100 into a folded configuration. Further, the gap 190 and the shape of the outer fold portion 186, along with the difference in thicknesses among portions of the collar 100, cooperate with the curvature of the fold line 106 and the shape of the leaf 102 and the stand 104 to retain the collar 100 flat against itself and against the garment 168 when in the folded configuration, as illustrated in FIG. 2.

Figure 4:
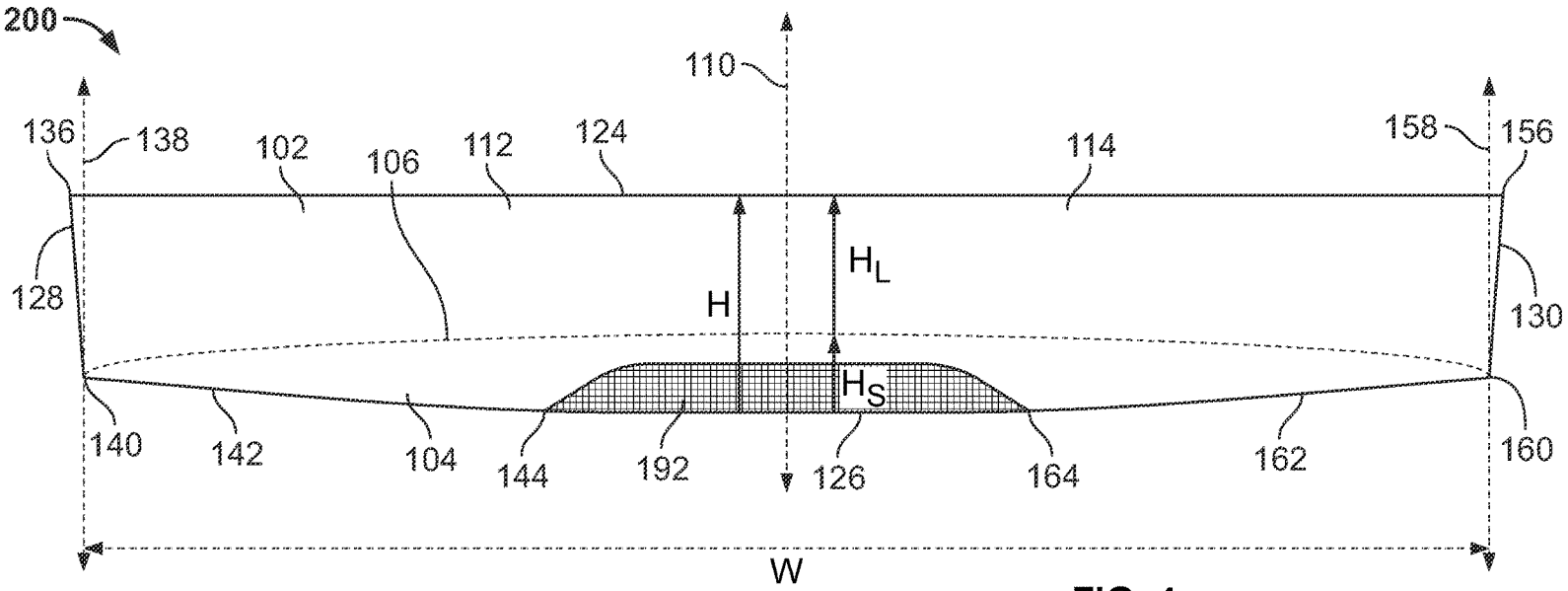
FIG. 4 is a planar view of another embodiment of a collar.

Referring back to FIG. 1, the stand 104 of the collar 100 can include a mesh structure or portion 192. In some examples, the entire stand 104 is composed of the mesh portion 192, as illustrated in the collar 100 of FIG. 1. Alternatively, the stand 104 may only partially include a mesh portion 192, as depicted in another example collar 200 in FIG. 4, in which like reference numerals identify like elements. The mesh portion 192 may extend along the inner edge 126 between the first inflexion point 144 and the second inflexion point 164, such that the mesh portion 192 extends within the first region 112 and the second region 114. The mesh portion 192 further extends from the inner edge 126 toward the fold line 106 but without extending all the way to the fold line 106. Accordingly, the mesh portion 192 may be partially or entirely spaced apart from the fold line 106. As depicted in FIG. 4, the mesh portion 192 may be shaped similar to a trapezoid, having substantially parallel top and bottom edges and angled side edges that extend therebetween. In other examples, the mesh portion 192 may be semi-circle-, or triangle-, or rectangle-, or diamond-, or polygon-shaped. In some examples, the mesh portion 192 may be irregularly shaped, formed of a combination of geometric shapes, formed to represent alphanumeric symbols, formed to represent branding, or formed as any other suitable shape or combination of shapes. The mesh portion 192 may include a continuous region, or the mesh portion 192 may be formed of discrete regions that are spaced apart from each other along the stand 104.

In some embodiments the total height H of the collar 100 or the collar 200 may be between about 3 centimeters and about 15 centimeters. Optionally the total height H of the collar 100 or the collar 200 may be between 6 centimeters and about 7 centimeters. In some embodiments, the leaf height $H_L$ may be between about 50% and about 90% of the total height H of the collar. In some embodiments, the stand height $H_S$ may be between about 10% and about 50% of the total height H of the collar 100 or the collar 200. In some embodiments, the width W of the collar 100 or the collar 200 is between about 30 centimeters and about 60 centimeters. Optionally, the collar 100 or the collar 200 may have a width W that is between about 40 centimeters and about 50 centimeters. In some embodiments, the mesh portion 192 may comprise about 50% of the total area of the collar 100. In some embodiments, the mesh portion 192 may comprise more or less than 50% of the total area of the collar 100 or the collar 200. In some embodiments, the mesh portion 192 may extend an entire width W of the collar 100. In some embodiments, the mesh portion 192 may extend less than 50% of the width W of the collar 100 or the collar 200.

It will be appreciated that the collars 100, 200 may be manufactured according to a variety of methods. For example, a method of kitting the collar 100 may include the steps of producing the leaf 102, next producing the fold line 106, and then producing the stand 104. The knitting method may occur in a single knitting direction, or in several knitting directions. The knitting method may take place on a knitting machine, such as a V-bed knitting machine. The knitting machine may include a first bed, a first set of needles, a second bed, and a second set of needles. The first set of needles may be selectively activated alone or simultaneously with the second set of needles, and a partial number of the first set of needles and the second set of needles may be selectively activated, such that only some of the first set of needles or some of the second set of needles are activated. Any portion of the collar 100, such as the leaf 102 or the stand 104 or the fold line 106, may be manufactured by activating some or all of the first set of needles, some or all of the second set of needles, or a combination thereof.

The collar 100 may be made out of a suitable material, such as nylon, carbon, polyurethane, polyester, cotton, aramid, polyethylene, polypropylene, spandex, elastane, or any other appropriate material or blend thereof, as would be appreciated by one of ordinary skill in the relevant art. As a non-limiting example, the collar 100 may comprise 150 denier (50 D)/48 filament (48F)/4 ply polyester and 40 denier (40 D) elastane. Another version of the collar 100 may comprise 30 single (30S)/4ply cotton and 40 denier (40 D) elastane. In some examples, collar 100 or portions thereof may be comprised of a one-by-one rib structure, and the needle size used for manufacturing the collar may be fourteen (14) gauge.

Many garments, and components thereof, are formed from multiple elements (e.g., textiles, polymer foam, polymer sheets, leather, and synthetic leather) that are joined through bonding or stitching at a seam. In some embodiments, the collar and/or garment according to an embodiment of the invention is formed from a knitted structure or knitted components. In various embodiments, a knitted component may incorporate various types of yarn that may provide different properties to a collar and/or garment. For example, one area of a collar may be formed from a first type of yarn that imparts a first set of properties, and another area of the collar may be formed from a second type of yarn that imparts a second set of properties. Using this configuration, properties of a collar may vary throughout by selecting specific yarns for different areas.

In some implementations, garments and/or collars disclosed herein can be constructed using methods embodying aspects of the invention. Correspondingly, description herein of particular features or capabilities of a feature or combination of features is generally intended to inherently include disclosure of a method of using such features in the construction of an article of clothing. Similarly, express discussion of any method of constructing a particular article of clothing, unless otherwise indicated or limited, is intended to inherently include disclosure, as embodiments of the invention, of the utilized features and implemented capabilities of such features or combination of features.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A collar for a garment, the collar comprising:

a leaf including an outer edge that extends between a first corner at a first edge and a second corner at a second edge;

a stand including a concavely curved inner edge that extends between a first intersection at the first edge and a second intersection at the second edge; and a fold line adjoining the leaf to the stand, the fold line being convexly curved between the first intersection and the second intersection, wherein only the stand is formed as a mesh structure and the leaf is devoid of a mesh structure, wherein a thickness of the collar along the fold line is less than a thickness of the leaf or a thickness of the stand, wherein the fold line forms a gap between the leaf and the stand, wherein the gap and the thickness of the collar along the fold line cooperate to bias the collar into a folded configuration, and wherein a leaf height $H_L$ is defined between the outer edge and the fold line, a stand height $H_S$ is defined between the inner edge and the fold line, and the leaf height is greater than the stand height along a width W of the collar along a central axis that bisects the outer edge between the first corner and the second corner, the width W being a distance between the first edge and the second edge.

2. The collar of claim 1, wherein the collar is composed of polyester yarn and elastane yarn.

3. The collar of claim 1, wherein the collar is composed of cotton yarn and elastane yarn.

4. The collar of claim 1, wherein the outer edge of the leaf extends linearly between the first edge and the second edge.

5. The collar of claim 1, wherein the collar includes an inner side and an outer side, the inner side having a protruding portion along the fold line and the outer side having the gap along the fold line.

6. The collar of claim 1, wherein the fold line curves continuously between the first edge and the second edge of the collar.

7. The collar of claim 1, wherein the fold line intersects the first edge and the inner edge at the first intersection.

8. The collar of claim 1, wherein a distance between the outer edge of the leaf and the inner edge of the stand is greatest at a central plane that is positioned equidistant from the first edge and the second edge of the leaf.

9. The collar of claim 1, wherein a distance between the first corner and the second corner is greater than a distance between the first intersection and the second intersection.

10. The collar of claim 1, wherein the leaf is at least one of a woven textile or a non-woven textile.

11. The collar of claim 1, wherein the stand is at least one of a woven textile or a non-woven textile.

12. A collar for a garment, the collar comprising:

a leaf including an outer edge that extends linearly between a first edge and a second edge, wherein a central plane bisects the collar between the first edge and the second edge;

a stand including an inner edge; and a fold line adjoining the leaf to the stand, the fold line being convexly curved between the first edge and the second edge, wherein the fold line forms a gap between the leaf and the stand, the collar having a density, as measured in grams per square meter, along the fold line which is less than a density of the leaf or a density of the stand, wherein the gap and the density of the collar along the fold line cooperate to bias the collar into a folded configuration, wherein the fold line intersects the first edge and the inner edge at a first intersection, wherein the inner edge extends substantially perpendicular to the central plane between a first inflexion point and the central plane and curves relative to the central plane between the first inflexion point and the first intersection, the first inflexion point being disposed closer to the central plane than to the first intersection, wherein the first edge extends at an angle between the first intersection and the outer edge, and wherein only the stand includes a mesh portion and the leaf is devoid of a mesh portion.

13. The collar of claim 12, wherein the entire stand is formed as a mesh structure.

14. The collar of claim 12, wherein the fold line extends within a first region between the first intersection and the central plane, the fold line having a curvature defined by a radius of curvature about the first inflexion point of the inner edge.

15. The collar of claim 14, wherein the radius of curvature varies along the fold line between the first intersection and the central plane.

16. The collar of claim 14, wherein the curvature of the fold line is steeper near the first intersection and gradually flattens toward the central plane.

17. The collar of claim 14, wherein a total height H of the collar within the first region is constant between the first inflexion point and the central plane.

18. The collar of claim 17, wherein a stand height $H_S$ is defined between the inner edge and the fold line, a leaf height $H_L$ is defined between the outer edge and the fold line, and wherein the leaf height $H_L$ is larger than the stand height $H_S$ at the central plane.

19. The collar of claim 18, wherein the leaf height $H_L$ is between about 50% and about 90% of the total height H of the collar.

20. The collar of claim 12, wherein the inner edge extends substantially perpendicular to the central plane between a second inflexion point and the central plane and curves relative to the central plane between the second inflexion point and the second intersection, the second inflexion point being disposed closer to the central plane than to a second intersection.

21. The collar of claim 12, wherein the density of the collar along the fold line is associated with at least one of material selection or a method of forming fabric.

* * * * *